US012768578B2

(12) United States Patent
Ikushima et al.

(10) Patent No.: US 12,768,578 B2
(45) Date of Patent: Oct. 20, 2026

(54) CRYOCOOLER DIAGNOSTIC SYSTEM, CRYOCOOLER, AND CRYOCOOLER DIAGNOSTIC METHOD

(71) Applicant: SUMITOMO HEAVY INDUSTRIES, LTD., Tokyo (JP)

(72) Inventors: Yuki Ikushima, Nishitokyo (JP); Tatsuki Nishio, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 190 days.

(21) Appl. No.: 18/670,736

(22) Filed: May 22, 2024

(65) Prior Publication Data

US 2024/0310095 A1 Sep. 19, 2024

Related U.S. Application Data

(63) Continuation of application No. PCT/JP2022/039684, filed on Oct. 25, 2022.

(30) Foreign Application Priority Data

Nov. 25, 2021 (JP) ..... 2021-191466

(51) Int. Cl.
*F25B 49/00* (2006.01)
*F25B 9/14* (2006.01)

(52) U.S. Cl.
CPC ..... *F25B 49/00* (2013.01); *F25B 9/14* (2013.01); *F25B 2500/06* (2013.01); *F25B 2500/19* (2013.01); *F25B 2700/19* (2013.01)

(58) Field of Classification Search
CPC ..... F25B 9/14; F25B 49/00; F25B 2500/06; F25B 2500/19; F25B 2700/19; F25B 9/145; F25B 2309/1411; F25B 49/005
See application file for complete search history.

(56) References Cited

U.S. PATENT DOCUMENTS

| | | | | |
|---|---|---|---|---|
| 9,395,108 | B2 * | 7/2016 | Morie | F25B 9/14 |
| 9,480,934 | B2 * | 11/2016 | Matsui | F25B 45/00 |
| 9,823,308 | B2 | 11/2017 | Rodriguez | |
| 10,968,842 | B2 | 4/2021 | Banerjee et al. | |
| 11,333,409 | B2 | 5/2022 | Mizuno et al. | |
| 2007/0043534 | A1 * | 2/2007 | Arruda | G01M 3/3236 702/183 |

(Continued)

FOREIGN PATENT DOCUMENTS

| | | | | |
|---|---|---|---|---|
| EP | 3865789 | A1 * | 8/2021 | F25B 9/02 |
| JP | 2013185480 | A | 9/2013 | |

(Continued)

*Primary Examiner* — Kun Kai Ma
(74) *Attorney, Agent, or Firm* — HEA Law PLLC

(57) ABSTRACT

A cryocooler diagnostic system includes a cryocooler including a pressure sensor that measures a pressure inside the cryocooler, a calculation processing device configured to receive a measured pressure waveform indicating the pressure inside the cryocooler measured by the pressure sensor, and calculate an amplitude of a drive frequency of the cryocooler or of a frequency component that is an integer multiple of the drive frequency from the measured pressure waveform, and a diagnostic device configured to receive the amplitude calculated by the calculation processing device and diagnose the cryocooler based on the amplitude.

8 Claims, 7 Drawing Sheets

(56) References Cited

U.S. PATENT DOCUMENTS

| | | | | |
|---|---|---|---|---|
| 2009/0282842 | A1* | 11/2009 | Koyama | F28F 9/0282 62/172 |
| 2010/0037639 | A1* | 2/2010 | Ogden | F25B 9/00 62/127 |
| 2020/0263907 | A1* | 8/2020 | Mizuno | F25B 9/145 |

FOREIGN PATENT DOCUMENTS

| | | | | |
|---|---|---|---|---|
| JP | 2014512799 | A | 5/2014 | |
| JP | 2014526643 | A | 10/2014 | |
| JP | 2020134007 | A | 8/2020 | |
| KR | 20200045486 | A * | 5/2020 | G01N 29/036 |
| WO | WO-2006003937 | A1 * | 1/2006 | G01R 33/3815 |

* cited by examiner

CRYOCOOLER DIAGNOSTIC SYSTEM, CRYOCOOLER, AND CRYOCOOLER DIAGNOSTIC METHOD

CROSS-REFERENCE TO RELATED APPLICATIONS

This is a bypass continuation of International PCT Application No. PCT/JP2022/039684, filed on Oct. 25, 2022, which claims priority to Japanese Patent Application No. 2021-191466, filed on Nov. 25, 2021, which are incorporated by reference herein in their entirety.

BACKGROUND

Technical Field

A certain embodiment of the present invention relates to a cryocooler diagnostic system, a cryocooler, and a cryocooler diagnostic method.

Description of Related Art

In the related art, with regard to a cryocooler such as a Gifford-McMahon (GM) cryocooler, a method of operating the cryocooler is known in which a pressure on a high pressure side and a pressure on a low pressure side are measured inside a compressor, and the compressor is controlled to keep a differential pressure between the high pressure side and the low pressure side constant.

SUMMARY

In a cryocooler, pressure measurement may be generally performed as described above, but a purpose thereof is usually limited to the differential pressure control between the high pressure side and the low pressure side.

According to an embodiment of the present invention, there is provided a cryocooler diagnostic system including a cryocooler including a pressure sensor that measures a pressure inside the cryocooler, a calculation processing device configured to receive a measured pressure waveform indicating the pressure inside the cryocooler measured by the pressure sensor and calculate an amplitude of a drive frequency of the cryocooler or of a frequency component that is an integer multiple of the drive frequency from the measured pressure waveform, and a diagnostic device configured to receive the amplitude calculated by the calculation processing device and diagnose the cryocooler based on the amplitude.

According to another embodiment of the present invention, there is provided a cryocooler diagnostic system including a diagnostic device configured to diagnose a cryocooler based on an amplitude of a drive frequency of the cryocooler or of a frequency component that is an integer multiple of the drive frequency, the amplitude being calculated from a measured pressure waveform indicating a pressure inside the cryocooler.

According to still another embodiment of the present invention, there is provided a cryocooler including a pressure sensor that measures a pressure inside the cryocooler, and a calculation processing device configured to receive a measured pressure waveform indicating the pressure inside the cryocooler measured by the pressure sensor and calculate an amplitude of a drive frequency of the cryocooler or of a frequency component that is an integer multiple of the drive frequency from the measured pressure waveform.

According to still another embodiment of the present invention, there is provided a cryocooler diagnostic method including acquiring a measured pressure waveform indicating a pressure inside a cryocooler, calculating an amplitude of a drive frequency of the cryocooler or of a frequency component that is an integer multiple of the drive frequency from the measured pressure waveform, and diagnosing the cryocooler based on the amplitude.

DETAILED DESCRIPTION

Figure 1:
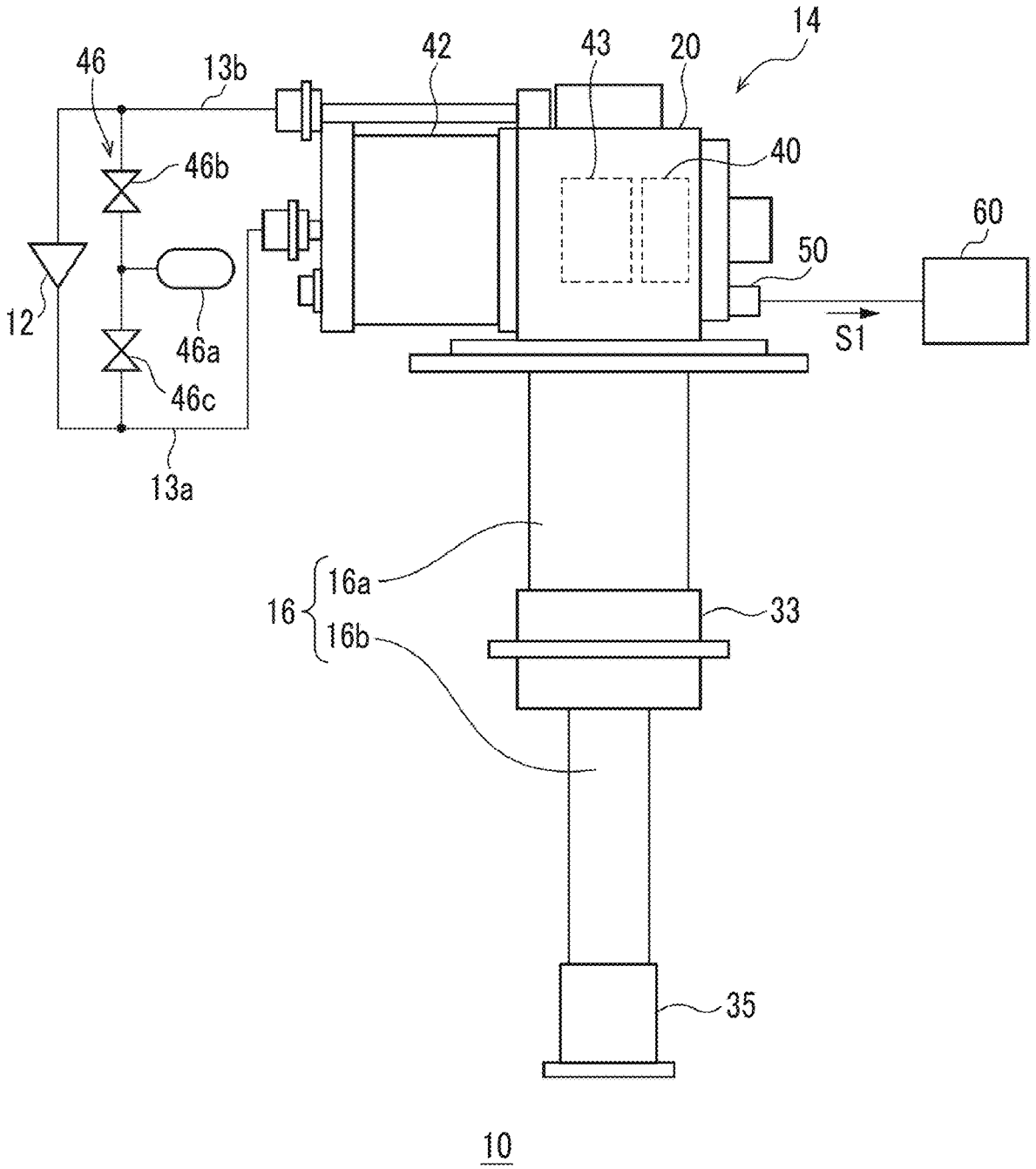
FIG. 1 is a diagram schematically showing a cryocooler according to an embodiment.

As a cryocooler is used in the field, a failure such as decreased refrigeration performance may occur because of abrasion of a sliding component, a life of a consumable component, or other reasons. An operation of a cryogenic system (for example, superconducting equipment or a magnetic resonance imaging (MRI) system) mounted with the cryocooler is required to be shut down until maintenance, such as repair of the failed cryocooler or replacement with a new one, is completed. In a case of a sudden failure, a time required for restoration tends to be relatively long, for example because it takes time to arrange a repair service. However, in a case where the failure can be predicted and dealt with in advance in a planned manner, an influence on the operation of the system can be minimized.

It is desirable to provide a diagnostic technique based on pressure measurement of a cryocooler.

Any combination of the components described above and a combination obtained by switching the components and expressions of the present invention between methods, devices, and systems are also effective as an aspect of the present invention.

Hereinafter, an embodiment for carrying out the present invention will be described in detail with reference to the drawings. In the description and the drawings, the same or equivalent components, members, and processes are denoted by the same reference numerals, and overlapping description is omitted as appropriate. The scale and the shape of each of parts shown in the drawings are set for convenience to make the description easy to understand, and are not to be interpreted as limiting unless stated otherwise. The embodiment is merely an example and does not limit the scope of the present invention. All features described in the embodiment or combinations thereof are not necessarily essential to the present invention.

Figure 2:
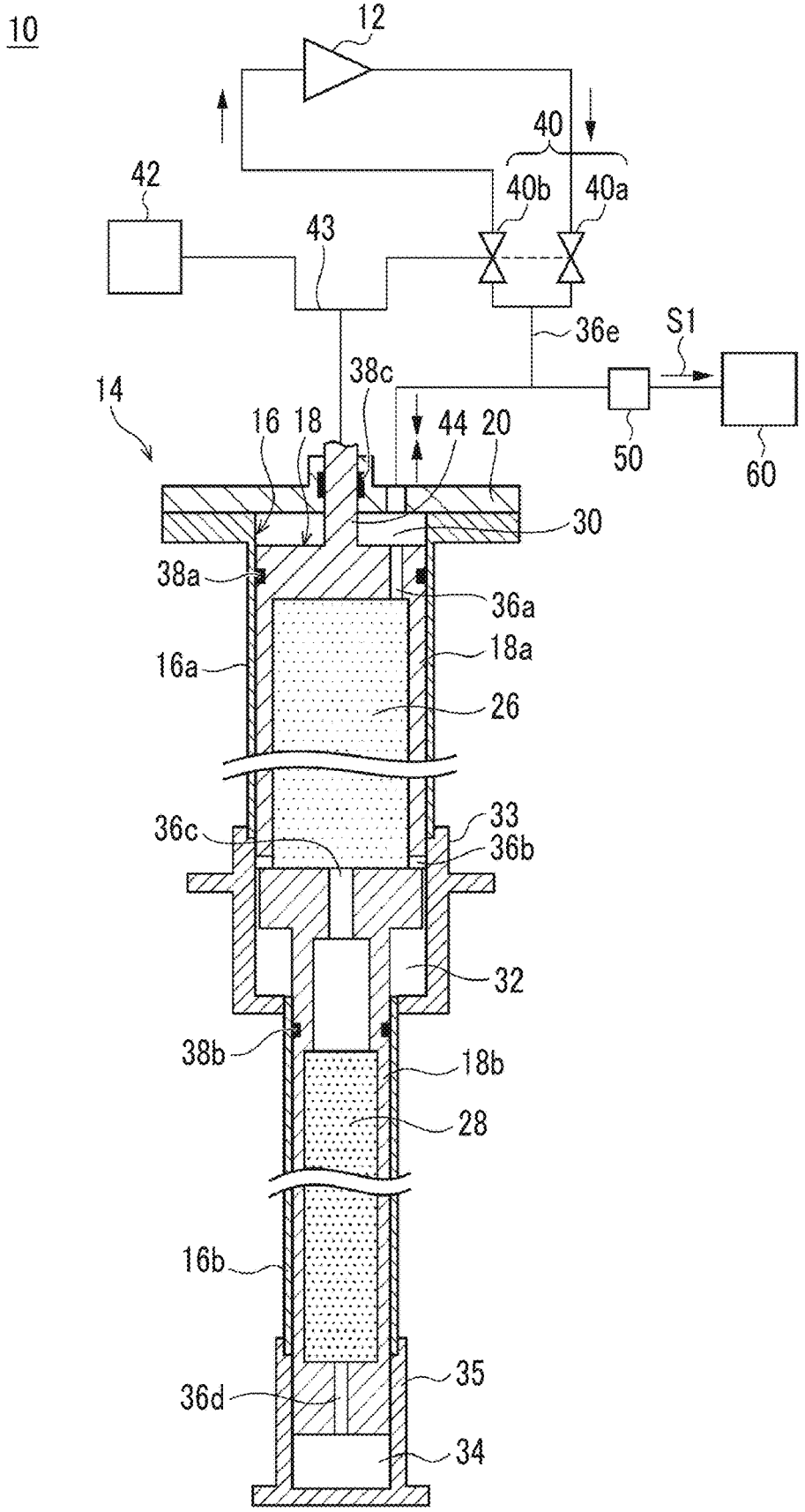
FIG. 2 is a diagram schematically showing the cryocooler according to the embodiment.

FIGS. 1 and 2 are diagrams schematically showing a cryocooler 10 according to the embodiment. As an example, the cryocooler 10 is a two-stage Gifford-McMahon (GM) cryocooler. FIG. 1 shows an appearance of the cryocooler 10, and FIG. 2 shows an internal structure of the cryocooler 10.

The cryocooler 10 includes a compressor 12 and an expander 14. The compressor 12 is configured to collect a working gas of the cryocooler 10 from the expander 14, to pressurize the collected working gas, and to supply the working gas to the expander 14 again.

The working gas is also referred to as a refrigerant gas, and other suitable gases may be used although a helium gas is typically used.

The expander 14 includes a cryocooler cylinder 16, a displacer assembly 18, and a cryocooler housing 20. The cryocooler housing 20 is coupled to the cryocooler cylinder 16 to thereby configure a hermetic container that accommodates the displacer assembly 18. An internal volume of the cryocooler housing 20 may be connected to a low pressure side of the compressor 12 and maintained at a low pressure.

The cryocooler cylinder 16 includes a first cylinder 16*a* and a second cylinder 16*b*. As an example, the first cylinder 16*a* and the second cylinder 16*b* are members having a cylindrical shape, and the second cylinder 16*b* has a smaller diameter than the first cylinder 16*a*. The first cylinder 16*a* and the second cylinder 16*b* are coaxially disposed, and a lower end of the first cylinder 16*a* is rigidly connected to an upper end of the second cylinder 16*b*.

The displacer assembly 18 includes a first displacer 18*a* and a second displacer 18*b*. As an example, the first displacer 18*a* and the second displacer 18*b* are members having a cylindrical shape, and the second displacer 18*b* has a smaller diameter than the first displacer 18*a*. The first displacer 18*a* and the second displacer 18*b* are coaxially disposed.

The first displacer 18*a* is accommodated in the first cylinder 16*a*, and the second displacer 18*b* is accommodated in the second cylinder 16*b*. The first displacer 18*a* can reciprocate in an axial direction along the first cylinder 16*a*, and the second displacer 18*b* can reciprocate in the axial direction along the second cylinder 16*b*. The first displacer 18*a* and the second displacer 18*b* are connected to each other and integrally move.

In the present specification, in order to describe a positional relationship between the components of the cryocooler 10, for convenience, a side close to a top dead center of the axial reciprocation of the displacer is described as "upper", and a side close to a bottom dead center is described as "lower". The top dead center is a position of the displacer where a volume of an expansion space is maximized, and the bottom dead center is the position of the displacer where the volume of the expansion space is minimized. Since a temperature gradient is generated in which a temperature drops from the upper side to the lower side in the axial direction during the operation of the cryocooler 10, the upper side can be referred to as a high temperature side and the lower side can be referred to as a low temperature side.

The first displacer 18*a* accommodates a first regenerator 26. The first regenerator 26 is formed by filling a tubular main body of the first displacer 18*a* with a wire mesh such as copper or other appropriate first regenerator material.

An upper lid portion and a lower lid portion of the first displacer 18*a* may be provided as separate members from the main body of the first displacer 18*a*, and the upper lid portion and the lower lid portion of the first displacer 18*a* may be fixed to the main body by appropriate means such as fastening or welding, whereby the first regenerator material may be accommodated in the first displacer 18*a*.

Similarly, the second displacer 18*b* accommodates a second regenerator 28. The second regenerator 28 is formed by filling a tubular main body of the second displacer 18*b* with a non-magnetic regenerator material such as bismuth, a magnetic regenerator material such as $HoCu_2$, or other appropriate second regenerator material. The second regenerator material may be formed in a granular shape. The upper lid portion and the lower lid portion of the second displacer 18*b* may be provided as separate members from the main body of the second displacer 18*b*, and the upper lid portion and the lower lid portion of the second displacer 18*b* may be fixed to the main body by appropriate means such as fastening or welding, whereby the second regenerator material may be accommodated in the second displacer 18*b*.

The displacer assembly 18 forms an upper chamber 30, a first expansion chamber 32, and a second expansion chamber 34 inside the cryocooler cylinder 16. The expander 14 includes a first cooling stage 33 and a second cooling stage 35 for heat exchange with a desired object or medium to be cooled by the cryocooler 10. The upper chamber 30 is formed between the upper lid portion of the first displacer 18*a* and the upper portion of the first cylinder 16*a*. The first expansion chamber 32 is formed between the lower lid portion of the first displacer 18*a* and the first cooling stage 33. The second expansion chamber 34 is formed between the lower lid portion of the second displacer 18*b* and the second cooling stage 35. The first cooling stage 33 is fixed to the lower portion of the first cylinder 16*a* to surround the first expansion chamber 32, and the second cooling stage 35 is fixed to the lower portion of the second cylinder 16*b* to surround the second expansion chamber 34.

The first regenerator 26 is connected to the upper chamber 30 through a working gas flow path 36*a* formed in the upper lid portion of the first displacer 18*a*, and is connected to the first expansion chamber 32 through a working gas flow path 36*b* formed in the lower lid portion of the first displacer 18*a*. The second regenerator 28 is connected to the first regenerator 26 through a working gas flow path 36*c* formed from the lower lid portion of the first displacer 18*a* to the upper lid portion of the second displacer 18*b*. In addition, the second regenerator 28 is connected to the second expansion chamber 34 through a working gas flow path 36*d* formed in the lower lid portion of the second displacer 18*b*.

A first seal 38*a* and a second seal 38*b* may be provided so that the working gas flow between the first expansion chamber 32, the second expansion chamber 34 and the upper chamber 30 is guided to the first regenerator 26 and the second regenerator 28 rather than to the clearance between the cryocooler cylinder 16 and the displacer assembly 18. The first seal 38*a* may be mounted to the upper lid portion of the first displacer 18*a* to be disposed between the first displacer 18*a* and the first cylinder 16*a*. The second seal 38*b* may be mounted to the upper lid portion of the second displacer 18*b* to be disposed between the second displacer 18*b* and the second cylinder 16*b*.

In addition, the expander 14 includes a pressure switching valve 40 and a drive motor 42. The pressure switching valve 40 is accommodated in the cryocooler housing 20, and the drive motor 42 is attached to the cryocooler housing 20.

As shown in FIG. 2, the pressure switching valve 40 includes a high pressure valve 40*a* and a low pressure valve 40*b*, and is configured to generate a periodic pressure fluctuation in the cryocooler cylinder 16. A working gas discharge port of the compressor 12 is connected to the upper chamber 30 via the high pressure valve 40*a*, and a working gas suction port of the compressor 12 is connected to the upper chamber 30 via the low pressure valve 40*b*. The high pressure valve 40*a* and the low pressure valve 40*b* are configured to be selectively and alternately opened and closed (that is, when one is open, the other is closed). A high pressure (for example, 2 to 3 MPa) working gas is supplied from the compressor 12 to the expander 14 through the high pressure valve 40*a*, and a low pressure (for example, 0.5 to 1.5 MPa) working gas is collected from the expander 14 to the compressor 12 through the low pressure valve 40*b*. For the sake of understanding, a flow direction of the working gas is shown by an arrow in FIG. 2.

The drive motor 42 is provided to drive the reciprocation of the displacer assembly 18. The drive motor 42 is connected to a displacer drive shaft 44 via a motion conversion mechanism 43 such as a scotch yoke mechanism. The motion conversion mechanism 43 is accommodated in the cryocooler housing 20 as with the pressure switching valve 40. The displacer drive shaft 44 extends from the motion conversion mechanism 43 through the cryocooler housing 20 into the upper chamber 30, and is fixed to the upper lid portion of the first displacer 18*a*. A third seal 38*c* is provided to prevent the working gas from leaking from the upper chamber 30 to the cryocooler housing 20 (which may be maintained at a low pressure as described above). The third seal 38*c* may be mounted on the cryocooler housing 20 to be disposed between the cryocooler housing 20 and the displacer drive shaft 44.

When the drive motor 42 is driven, the rotational output of the drive motor 42 is converted into the axial reciprocation of the displacer drive shaft 44 by the motion conversion mechanism 43, and the displacer assembly 18 reciprocates in the cryocooler cylinder 16 in the axial direction. In addition, the drive motor 42 is connected to the high pressure valve 40*a* and the low pressure valve 40*b* so as to selectively and alternately open and close the high pressure valve 40*a* and the low pressure valve 40*b*.

When the compressor 12 and the drive motor 42 are operated, the cryocooler 10 generates a periodic volume fluctuation and a pressure fluctuation of the working gas synchronized with the volume fluctuation in the first expansion chamber 32 and the second expansion chamber 34, whereby a refrigeration cycle is configured, and the first cooling stage 33 and the second cooling stage 35 are cooled to a desired cryogenic temperature. The first cooling stage 33 can be cooled to a first cooling temperature in a range of, for example, about 20 K to about 40 K. The second cooling stage 35 can be cooled to a second cooling temperature (for example, about 1 K to about 4 K) lower than the first cooling temperature.

In one embodiment, as shown in FIG. 1, the cryocooler 10 may include a gas amount adjusting unit 46 in order to adjust the amount of the working gas circulating through the compressor 12 and the expander 14 in the cryocooler 10. The gas amount adjusting unit 46 may include a working gas source 46*a* such as a buffer tank, a supply valve 46*b*, and a collection valve 46*c*. The working gas source 46*a* stores the working gas at an intermediate pressure between a discharge pressure (high pressure described above) and a suction pressure (low pressure described above) of the compressor 12. The supply valve 46*b* connects the working gas source 46*a* to a low pressure side pipe 13*b* that connects the compressor 12 and the expander 14, and the collection valve 46*c* connects the working gas source 46*a* to a high pressure side pipe 13*a* that connects the compressor 12 and the expander 14.

By opening the supply valve 46*b* and closing the collection valve 46*c*, the working gas can be supplied from the working gas source 46*a* to the low pressure side pipe 13*b*, and the amount of the working gas circulating through the cryocooler 10 can be increased. When the amount of the circulating working gas increases, a pressure of the high pressure side pipe 13*a* and a pressure of the low pressure side pipe 13*b* increase. On the contrary, by closing the supply valve 46*b* and opening the collection valve 46*c*, the working gas can be collected from the high pressure side pipe 13*a* to the working gas source 46*a*, and the amount of the working gas circulating through the cryocooler 10 can be decreased. When the amount of the circulating working gas decreases, the pressure of the high pressure side pipe 13*a* and the pressure of the low pressure side pipe 13*b* decrease.

The cryocooler 10 is cooled from an environmental temperature (for example, room temperature) to a cryogenic temperature (for example, the first and second cooling temperatures described above) at the time of activation, and is then maintained at the cryogenic temperature. Therefore, the cryocooler 10 operates in a considerably wide temperature range. A density of the working gas circulating through the cryocooler 10 changes due to a change in operating temperature, and thus the pressure also changes. Therefore, the amount of the working gas is increased or decreased by using the gas amount adjusting unit 46, so that the pressures on the high pressure side and the low pressure side of the cryocooler 10 can be optimally adjusted.

Figure 3:
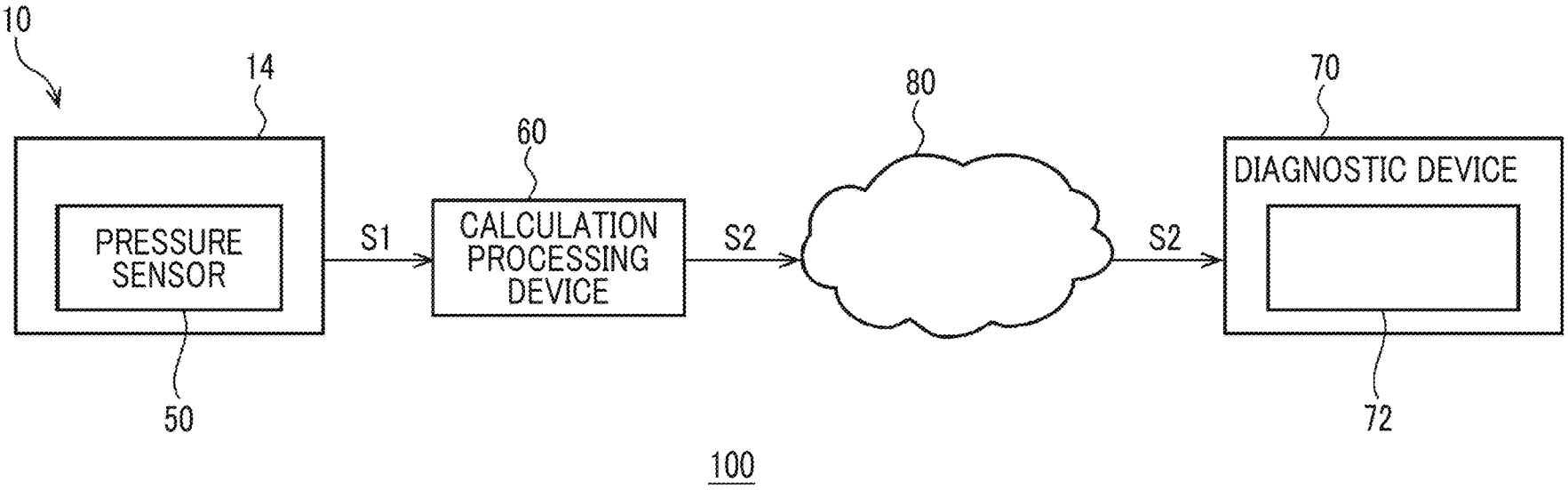
FIG. 3 is a block diagram schematically showing a diagnostic system for the cryocooler according to the embodiment.

FIG. 3 is a block diagram schematically showing a diagnostic system 100 for the cryocooler 10 according to the embodiment. The diagnostic system 100 includes a pressure sensor 50, a calculation processing device 60, and a diagnostic device 70.

The pressure sensor 50 is configured to measure the pressure inside the cryocooler 10. For example, the pressure sensor 50 is disposed to measure the periodic pressure fluctuation generated in the expander 14 by the pressure switching valve 40. As shown in FIG. 2, the pressure sensor 50 may be installed in, for example, a working gas flow path 36*e* connecting the pressure switching valve 40 and the upper chamber 30. The pressure sensor 50 may be attached to the cryocooler housing 20 as shown in FIG. 1.

Accordingly, the pressure sensor 50 measures the periodic pressure fluctuation of the upper chamber 30 and outputs a measured pressure waveform S1. The measured pressure waveform S1 shows a time change of a measurement value of the pressure sensor 50 during the operation of the cryocooler 10. The pressure sensor 50 is connected to the calculation processing device 60 in a communicable manner by wire or wirelessly.

The pressure sensor 50 may be installed in the cryocooler cylinder 16 to measure the pressure inside the cryocooler cylinder 16, for example, the pressure in the first expansion chamber 32 or the second expansion chamber 34. Even in this way, the pressure sensor 50 can measure the periodic pressure fluctuation generated in the expander 14 by the pressure switching valve 40.

In addition, as another alternative example, the pressure sensor 50 may be provided in the high pressure side pipe 13*a* connecting the compressor 12 and the expander 14 to measure the pressure of the high pressure side pipe 13*a*. Alternatively, the pressure sensor 50 may be provided in the low pressure side pipe 13*b* connecting the compressor 12 and the expander 14 to each other to measure the pressure of the low pressure side pipe 13*b*. Even in this way, the pressure sensor 50 can measure the periodic pressure fluctuation in the cryocooler 10 caused by the operation of the pressure switching valve 40, and the obtained measured pressure waveform S1 can be used for diagnosing the cryocooler 10.

The calculation processing device 60 is configured to receive the measured pressure waveform S1 from the pressure sensor 50, process the measured pressure waveform S1, and generate data S2 that can be used for diagnosing the cryocooler 10. The diagnostic device 70 is configured to receive the data S2 generated by the calculation processing device 60 and diagnose the cryocooler 10 based on the data S2. The calculation processing device 60 and the diagnostic device 70 are disposed in a surrounding environment (for example, a room temperature atmospheric pressure environment) as with the cryocooler housing 20 of the cryocooler 10.

In this embodiment, the diagnostic device 70 is disposed remotely from the calculation processing device 60 and is connected to the calculation processing device 60 in a communicable manner via, for example, the Internet or other appropriate communication network 80. The calculation processing device 60 outputs the generated data S2 to the communication network 80, and the diagnostic device 70 can receive the data S2 output from the calculation processing device 60 from the communication network 80.

In an exemplary use case, the calculation processing device 60 may be placed under the control of a user of the cryocooler 10 as a part of the cryocooler 10 or together with the cryocooler 10. On the other hand, the diagnostic device 70 may be placed under the control of a manufacturer of the cryocooler 10 or a service provider that provides a maintenance service such as repair of the cryocooler 10.

Alternatively, the calculation processing device 60 and the diagnostic device 70 may be disposed close to each other, or may be integrated with each other. In this case, both the calculation processing device 60 and the diagnostic device 70 may be placed under the control of the user of the cryocooler 10.

The diagnostic device 70 may include a notifier 72 that visually notifies of information indicating a diagnostic result, and the notifier 72 may include, for example, a display or a warning light.

The notifier 72 may notify of a diagnostic result with voice by using a speaker or the like. The notifier 72 may transmit the diagnostic result to other devices via the communication network 80.

The internal configurations of the calculation processing device 60 and the diagnostic device 70 are realized by elements and circuits such as a central processing unit (CPU) and a memory of a computer as a hardware configuration, and are realized by a computer program as a software configuration. However, in the drawings, the internal configurations are illustrated as functional blocks realized through the cooperation therebetween. Those skilled in the art will understand that these functional blocks can be realized in various forms including the combination of hardware and software.

Figure 4:
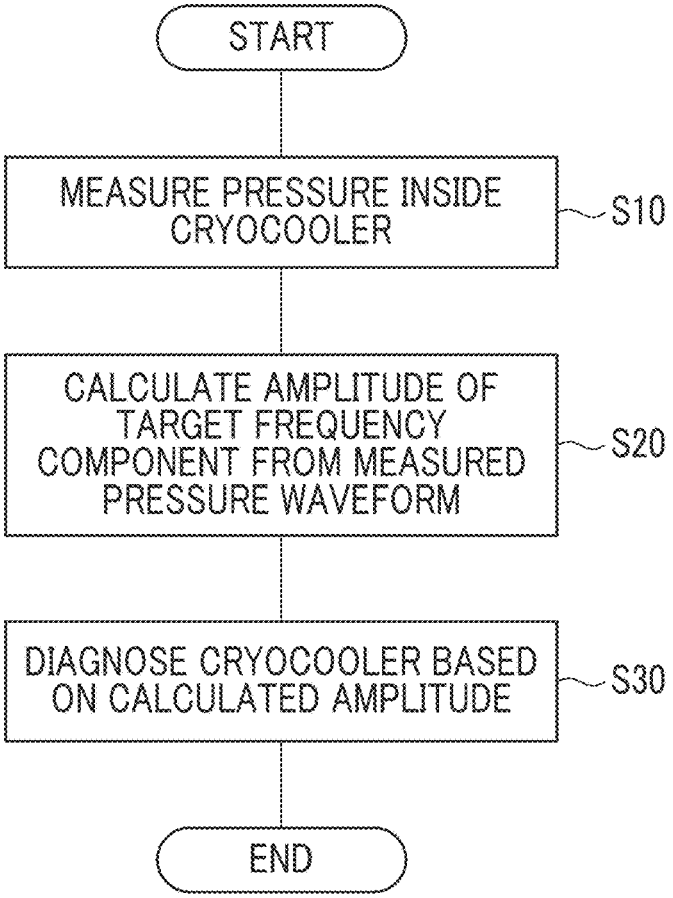
FIG. 4 is a flowchart showing a diagnostic method for the cryocooler according to the embodiment.

FIG. 4 is a flowchart showing a diagnostic method for the cryocooler 10 according to the embodiment. The present method includes acquiring the measured pressure waveform S1 indicating the pressure inside the cryocooler 10 (S10), calculating an amplitude of a target frequency component from the measured pressure waveform S1 (S20), and diagnosing the cryocooler 10 based on the calculated amplitude (S30).

In S10, the measured pressure waveform S1 is acquired by using the pressure sensor 50. The measured pressure waveform S1 may be acquired at any time during the operation of the cryocooler 10.

Alternatively, the cryocooler 10 may have an operation mode for diagnosis, and may execute the operation mode to acquire the measured pressure waveform S1. The operation mode for diagnosis may be executed during a time zone during which a cryocooler utilization facility, such as superconducting equipment or an MRI system, mounted with the cryocooler 10 is not used (for example, at night or during the maintenance work of the utilization facility). In the operation mode for diagnosis, the cryocooler 10 may be operated at a predetermined drive frequency. In addition, in the operation mode for diagnosis, the cryocooler 10 may be operated at a predetermined cooling temperature. In this way, the measured pressure waveforms S1 can be acquired under the same operation condition every time, which leads to an improvement in diagnosis accuracy.

In S20, using the calculation processing device 60, an amplitude of a drive frequency of the cryocooler 10 or of a frequency component that is an integer multiple of the drive frequency is calculated from the measured pressure waveform S1. For that purpose, the calculation processing device 60 is configured to receive the measured pressure waveform S1 and calculate the amplitude of the drive frequency of the cryocooler 10 or of the frequency component that is an integer multiple of the drive frequency from the measured pressure waveform S1. The calculation processing device 60 may calculate at least the amplitude of the drive frequency of the cryocooler 10 from the measured pressure waveforms S1.

Here, the drive frequency of the cryocooler 10 corresponds to the number of times of the refrigeration cycle of the cryocooler 10 per unit time, and is determined based on an operation frequency or a rotation speed of the drive motor 42 of the expander 14. The drive frequency is typically, for example, about 1 Hz. A value of the drive frequency may be input in advance to the calculation processing device 60 and stored therein. The calculation processing device 60 may obtain the drive frequency from the measured pressure waveform S1.

The calculation processing device 60 may be configured to calculate an amplitude for each of a plurality of frequency components among the drive frequency of the cryocooler 10 and the frequency components that are integer multiples of the drive frequency, from the measured pressure waveform S1. The calculation processing device 60 may calculate at least two amplitudes (for example, the amplitude of the drive frequency and the amplitude of the frequency component that is twice the drive frequency) selected from the amplitude of the drive frequency of the cryocooler 10, the amplitude of the frequency component that is twice the drive frequency, and the amplitude of the frequency component that is three times the drive frequency, or these three amplitudes.

In addition, the calculation processing device 60 may be configured to calculate a DC component (that is, an average pressure of the measured pressure waveform S1) of the measured pressure waveform S1, in addition to or instead of calculating the amplitude of the drive frequency of the cryocooler 10 or of the frequency component that is an integer multiple of the drive frequency.

The calculation processing device 60 may be a processor capable of executing fast Fourier transform (FFT) processing, and may calculate the amplitude of the target frequency component by applying the FFT processing to the measured pressure waveform S1. In this way, the data S2 generated by the calculation processing device 60 may include data indicating the calculated amplitude of the target frequency component and the calculated DC component.

In S30, using the diagnostic device 70, the cryocooler 10 is diagnosed based on the amplitude of the drive frequency of the cryocooler 10 or of the frequency component that is an integer multiple of the drive frequency. The diagnostic device 70 is configured to receive the amplitude calculated by the calculation processing device 60 and diagnose the cryocooler 10 based on the amplitude. As described above, in a case where the diagnostic device 70 is disposed remotely from the calculation processing device 60, the diagnostic device 70 is configured to receive the amplitude calculated by the calculation processing device 60 via the communication network 80.

In a case where a plurality of frequency components are calculated from the measured pressure waveform S1 by the calculation processing device 60 as described above, the diagnostic device 70 may be configured to receive the amplitudes of the plurality of frequency components and diagnose the cryocooler 10 based on the amplitudes of the plurality of frequency components. In a case where the DC component of the measured pressure waveform S1 is additionally calculated by the calculation processing device 60, the diagnostic device 70 may be configured to receive the calculated amplitude and DC component and diagnose the cryocooler 10 based on the amplitude and the DC component.

The diagnostic device 70 may compare the acquired amplitude with an amplitude threshold (and/or compare the acquired DC component with a threshold thereof) and diagnose the cryocooler 10 based on a comparison result. The diagnostic device 70 may detect a failure of the cryocooler 10 when the amplitude and/or the DC component reaches the threshold. Alternatively, the diagnostic device 70 may predict a failure of the cryocooler 10 that a failure is likely to occur in the near future when the amplitude and/or the DC component reaches the threshold. Such a threshold of the amplitude and/or the DC component can be appropriately set based on the empirical knowledge of a designer or experiments or simulations by the designer.

Alternatively, the diagnostic device 70 may include a diagnostic algorithm based on machine learning such as deep learning, and the diagnostic algorithm may be configured to output a diagnostic result for a specific diagnostic mode (for example, at least one of diagnostic modes described below) using the acquired amplitude and/or the acquired DC component as an input.

In this embodiment, the diagnostic device 70 is configured to diagnose a plurality of failure modes of the cryocooler 10. Some exemplary failure modes and diagnosis thereof will be described below with reference to FIGS. 5 to 10. In order to diagnose these failure modes, the calculation processing device 60 calculates the amplitude of the drive frequency (hereinafter, also referred to as a primary frequency) of the cryocooler 10, the amplitude of the frequency component (hereinafter, also referred to as a secondary frequency) that is twice the drive frequency, the amplitude of the frequency component (hereinafter, also referred to as a tertiary frequency) that is three times the drive frequency, and the DC component, from the measured pressure waveform S1.

FIGS. 5 to 10 show results of studies performed by the present inventor in order to demonstrate that first to sixth failure modes can be diagnosed by the diagnostic device 70. In each of FIGS. 5 to 10, a left side shows the measured pressure waveform S1, and a right side shows an amplitude and a DC component of a target frequency component. The measured pressure waveform S1 acquired for the normal cryocooler 10 is shown by a broken line, and the measured pressure waveform S1 acquired for the failed cryocooler 10 (more accurately, one configured or operated to simulate the failure mode in the normal cryocooler 10) is shown by a solid line. Similarly, the amplitude and the DC component acquired for the normal cryocooler 10 are shown by a broken line, and the amplitude and the DC component acquired for the failed cryocooler 10 are shown by a solid line.

Figure 5:
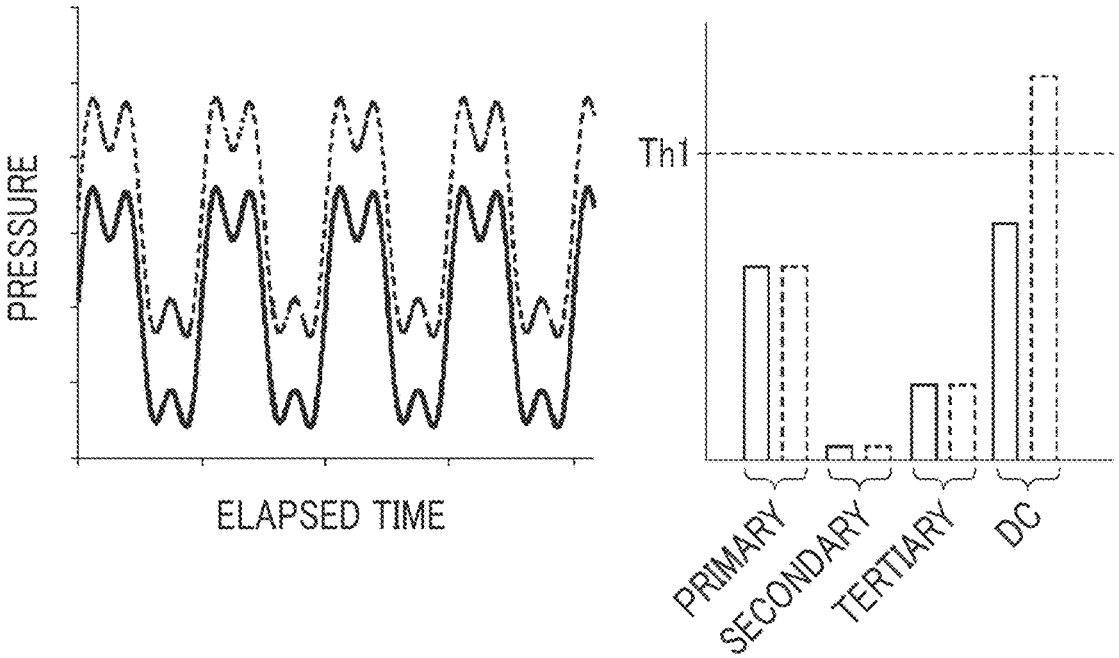
FIG. 5 is a diagram showing an exemplary failure mode and a diagnosis thereof.

The first failure mode shown in FIG. 5 is a lack of the pressure of the working gas filling the cryocooler 10. Even when a lack of the filling pressure occurs, a differential pressure between the high pressure side and the low pressure side is maintained by the normal operation of the compressor 12. Therefore, the measured pressure waveform S1 of the first failure mode is parallel-moved downward with respect to the measured pressure waveform S1 in the normal state. Accordingly, the first failure mode appears in the DC component of the measured pressure waveform S1. The amplitudes of other frequency components including the primary frequency do not change because the waveform is maintained.

Therefore, a first threshold Th1 is set for the DC component of the measured pressure waveforms S1. The diagnostic device 70 compares the DC component of the measured pressure waveform S1 with the first threshold Th1, and diagnoses the first failure mode based on a comparison result. For the first failure mode, the diagnostic device 70 determines that the first failure mode is normal when the DC component of the measured pressure waveform S1 exceeds the first threshold Th1, and determines that the first failure mode is abnormal when the DC component of the measured pressure waveform S1 falls below the first threshold Th1. In this way, the diagnostic device 70 can detect or predict the first failure mode, that is, the lack of the filling pressure of the cryocooler 10.

Figure 6:
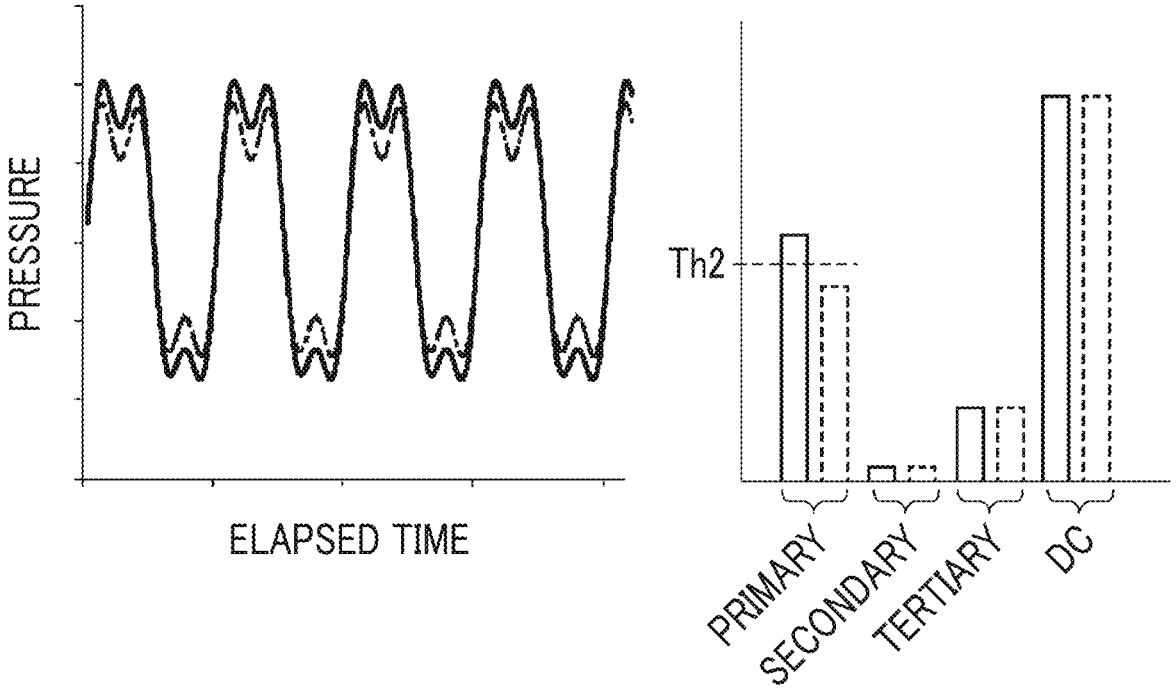
FIG. 6 is a diagram showing an exemplary failure mode and a diagnosis thereof.

The second failure mode shown in FIG. 6 is a lack of cooling due to an increase in pressure loss in the expander 14. Since the working gas is difficult to flow in the expander 14 because of the increase in pressure loss, the measured pressure waveform S1 of the second failure mode has a higher pressure on the high pressure side and a lower pressure on the low pressure side than the measured pressure waveform S1 in the normal state. That is, the differential pressure is increased. Because of the influence, the second failure mode appears in the amplitude of the primary frequency of the measured pressure waveform S1. As shown, it can be seen that the amplitudes of the secondary frequency and the tertiary frequency do not change. Since the average pressure is maintained, the DC component does not change.

Therefore, a second threshold Th2 is set for the amplitude of the primary frequency. The diagnostic device 70 compares the amplitude of the primary frequency of the measured pressure waveform S1 with the second threshold Th2, and diagnoses the second failure mode based on a comparison result. For the second failure mode, the diagnostic device 70 determines that the second failure mode is normal when the amplitude of the primary frequency falls below the second threshold Th2, and determines that the second failure mode is abnormal when the amplitude of the primary frequency exceeds the second threshold Th2. In this way, the diagnostic device 70 can detect or predict the second failure mode, that is, the increase in pressure loss in the expander 14.

Figure 7:
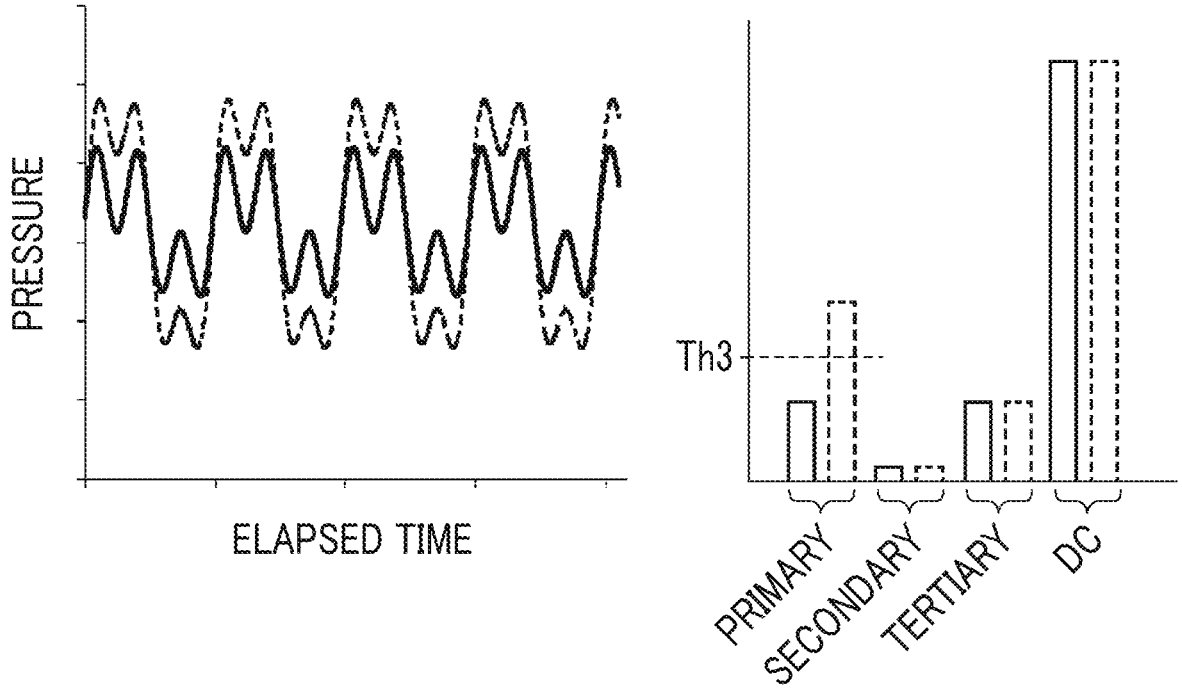
FIG. 7 is a diagram showing an exemplary failure mode and a diagnosis thereof.

The third failure mode shown in FIG. 7 is a high-to-low pressure blow-by. This means that the working gas leaks from a high pressure region to a low pressure region in the expander 14, and a cause of the leakage may be, for example, a deterioration of a seal portion (for example, the third seal 38*c*) in the expander 14, or a leakage on a rotary sliding surface of the pressure switching valve 40 when the pressure switching valve 40 is configured of a rotary valve. The high-to-low pressure blow-by can cause a decrease in cooling capacity of the cryocooler 10.

The measured pressure waveform S1 of the third failure mode has a lower pressure on the high pressure side and a higher pressure on the low pressure side than the measured pressure waveform S1 in the normal state. Since the differential pressure is reduced in this way, the third failure mode appears in the amplitude of the primary frequency of the measured pressure waveform S1. As shown, it can be seen that the amplitudes of the secondary frequency and the tertiary frequency do not change. Since the average pressure is maintained, the DC component does not change.

Therefore, a third threshold Th3 is set for the amplitude of the primary frequency. The diagnostic device 70 compares the amplitude of the primary frequency of the measured pressure waveform S1 with the third threshold Th3, and diagnoses the third failure mode based on a comparison result. For the third failure mode, the diagnostic device 70 determines that the third failure mode is normal when the amplitude of the primary frequency exceeds the third threshold Th3, and determines that the third failure mode is abnormal when the amplitude of the primary frequency falls below the third threshold Th3. In this way, the diagnostic device 70 can detect or predict the third failure mode, that is, the high-to-low pressure blow-by in the expander 14.

Figure 8:
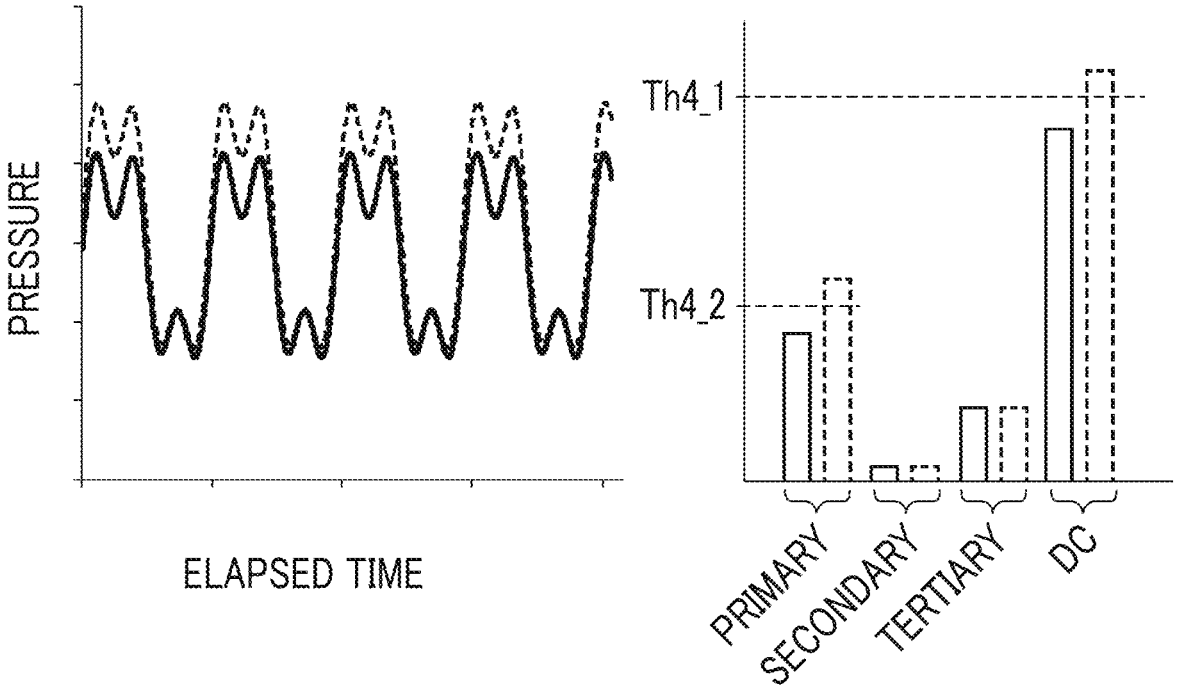
FIG. 8 is a diagram showing an exemplary failure mode and a diagnosis thereof.

The fourth failure mode shown in FIG. 8 is a high pressure drop of the compressor 12. This is considered to be caused by, for example, an increase in pressure loss in a component (for example, an adsorber) provided in the working gas flow path on the high pressure side of the compressor 12, or by other abnormality. The high pressure drop of the compressor 12 may also cause a decrease in cooling capacity of the cryocooler 10. Because of the drop in high pressure, the fourth failure mode appears in the DC component and the amplitude of the primary frequency of the measured pressure waveform S1. As shown, it can be seen that the amplitudes of the secondary frequency and the tertiary frequency do not change.

Therefore, for the fourth failure mode, a fourth threshold Th4_1 is set for the DC component of the measured pressure waveforms S1, and another threshold Th4_2 is set for the amplitude of the primary frequency. The diagnostic device 70 compares the DC component of the measured pressure waveform S1 with the fourth threshold Th4_1 and compares the amplitude of the primary frequency of the measured pressure waveform S1 with the other threshold Th4_2, and diagnoses the fourth failure mode based on comparison results. The diagnostic device 70 determines that the fourth failure mode is normal when any one of (i) the DC component of the measured pressure waveforms S1 exceeding the fourth threshold Th4_1 or (ii) the amplitude of the primary frequency exceeding the threshold Th4_2 is established. In addition, the diagnostic device 70 determines that the fourth failure mode is abnormal when the DC component of the measured pressure waveform S1 falls below the fourth threshold Th4_1 and the amplitude of the primary frequency falls below the threshold Th4_2.

In this way, the diagnostic device 70 can detect or predict the fourth failure mode, that is, the high pressure drop of the compressor 12. The first failure mode and the fourth failure mode can be distinguished from each other by observing both the DC component and the amplitude of the primary frequency.

Figure 9:
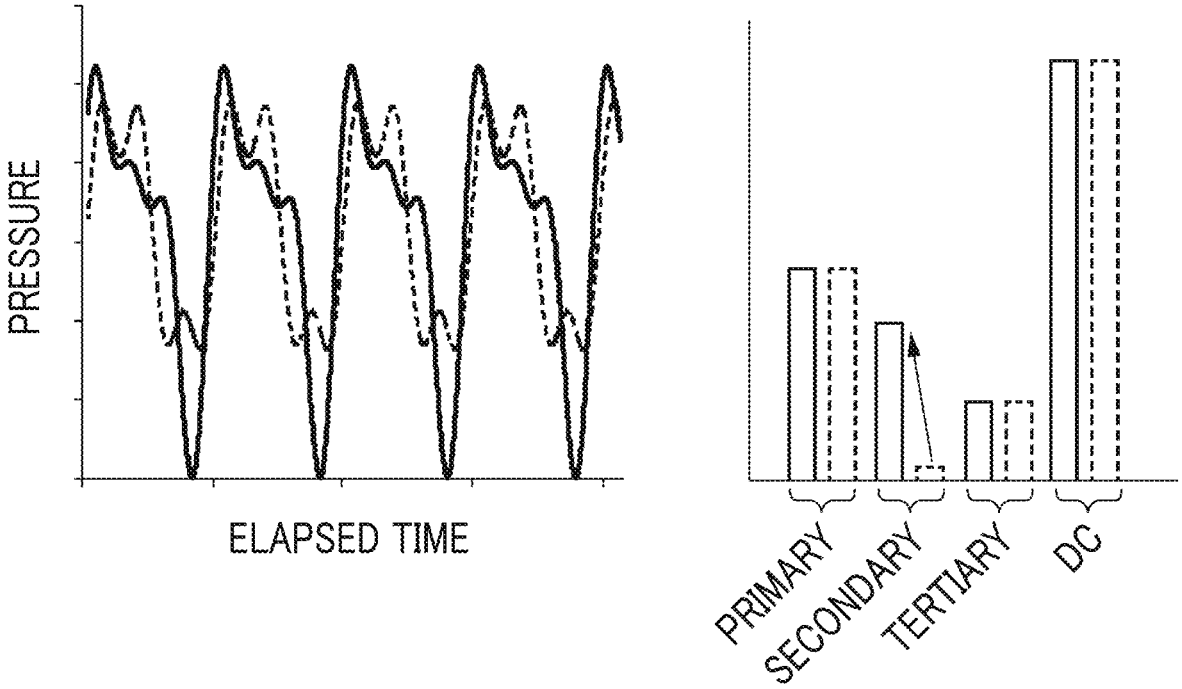
FIG. 9 is a diagram showing an exemplary failure mode and a diagnosis thereof.

The fifth failure mode shown in FIG. 9 is an abnormality of the pressure sensor 50. The diagnostic device 70 may acquire a magnitude relationship between the amplitudes of the target frequency components calculated from the measured pressure waveforms S1, and diagnose the fifth failure mode based on the magnitude relationship. As can be understood from the drawing, the normal cryocooler 10 has a tendency in which the amplitude of the primary frequency is the largest, the amplitude of the tertiary frequency is the next largest, and the amplitude of the secondary frequency is smallest among these. On the other hand, in the measured pressure waveforms S1 of the fifth failure mode shown in FIG. 9, for example, the amplitude of the secondary frequency is larger than the amplitude of the tertiary frequency. Therefore, in a case where a magnitude relationship different from the magnitude relationship of the amplitude in the normal state, that is, "primary amplitude>tertiary amplitude>secondary amplitude" occurs, the diagnostic device 70 can determine that the pressure sensor 50 is abnormal.

Figure 10:
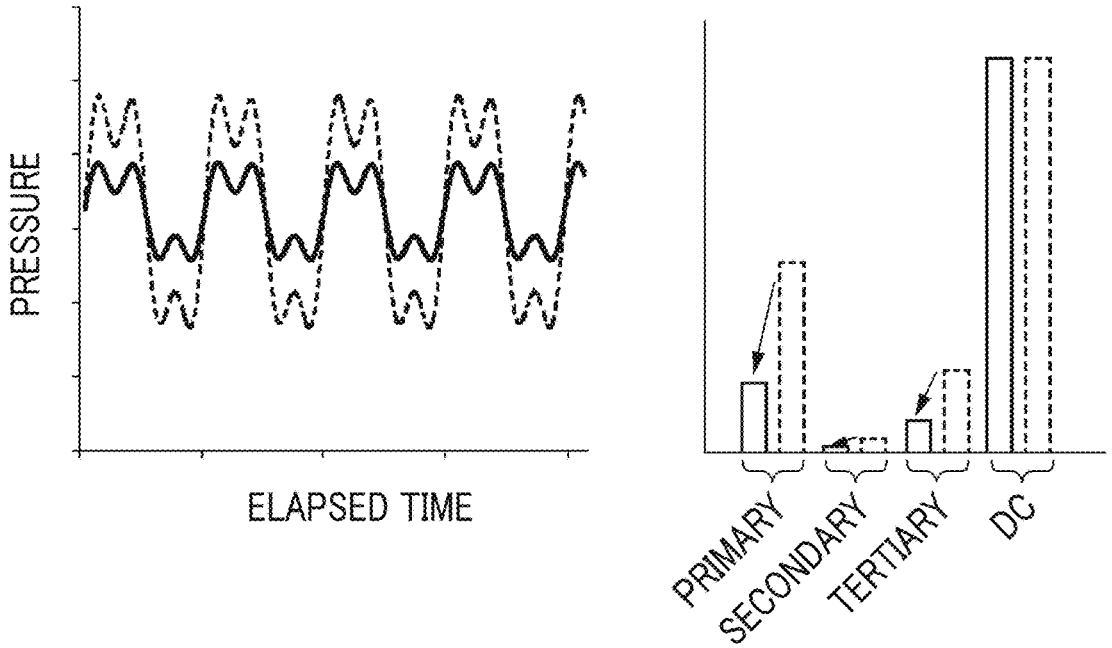
FIG. 10 is a diagram showing an exemplary failure mode and a diagnosis thereof.

The sixth failure mode shown in FIG. 10 is a motor slip. In this case, the rotation of the drive motor 42 becomes irregular, the periodic pressure fluctuation in the expander 14 is also disturbed. As a result, the amplitude of the target frequency component calculated from the measured pressure waveform S1 decreases. As shown, not only the amplitude of the primary frequency but also the amplitudes of the secondary frequency and the tertiary frequency decrease. Therefore, for the sixth failure mode, a threshold is set for each of the plurality of calculated frequency components, and the diagnostic device 70 compares the amplitude of each frequency component with a corresponding threshold, and diagnoses the sixth failure mode based on comparison results. For the sixth failure mode, the diagnostic device 70 may determine that the sixth failure mode is abnormal when the amplitudes of all the frequency components fall below the respective thresholds, and may determine that the sixth failure mode is normal in other cases.

As described above, according to the embodiment, it is possible to provide a diagnostic technique based on the pressure measurement of the cryocooler 10. The drive frequency of the cryocooler or the frequency component that is an integer multiple of the drive frequency is expected to include information reflecting the operation and the performance of the cryocooler 10, and the frequency component can be used to diagnose various failure modes as described above.

In addition, by processing the measured pressure waveform S1 into amplitude data, the amount of data used for diagnosis can be significantly reduced. In order to express the measured pressure waveform S1 for one cycle of the refrigeration cycle with sufficient reproducibility, a large number of pressure measurement points are required, while only one value of the amplitude is required for one cycle of the refrigeration cycle. Therefore, the embodiment is suitable in a case where the diagnostic device 70 is disposed remotely from the calculation processing device 60. By processing the measured pressure waveform S1 into amplitude data, the amount of communication data from the calculation processing device 60 to the diagnostic device 70 via the communication network 80 can be reduced.

In a case where the cryocooler suddenly fails, a time required for restoration tends to be relatively long. For example, in a case where a repair service for the cryocooler is busy, the user may have to wait several days or more until the repair is completed. It may not be possible to operate the system as scheduled, which is an issue. In addition, in a system in which a cryogenic refrigerant such as liquid helium is used for cooling, the refrigerant cannot be recondensed while the cryocooler is shut down. The longer the shutdown period of the cryocooler, the greater the amount of refrigerant evaporated and lost, and the more refrigerant may have to be replenished. In particular, in a case where the refrigerant is liquid helium, since liquid helium is expensive in recent years, a financial burden on the user increases.

However, according to the embodiment, since the cryocooler 10 can be diagnosed, the user or the service provider of the cryocooler 10 or the system (for example, the MRI system) mounted with the cryocooler 10 can plan maintenance such as repair or replacement with a new product in advance. By setting the maintenance at a convenient timing, the influence on the operation of the system can be minimized. A loss of the refrigerant due to evaporation is also reduced, and an operating cost of the system can also be reduced.

In addition, in one embodiment, the diagnostic device 70 may be configured to acquire the measured pressure waveform S1 and diagnose the cryocooler 10 based on the measured pressure waveform S1. For example, the diagnostic device 70 may diagnose the above-described third failure mode (high-to-low pressure blow-by) based on the measured pressure waveform S1.

Figure 11:
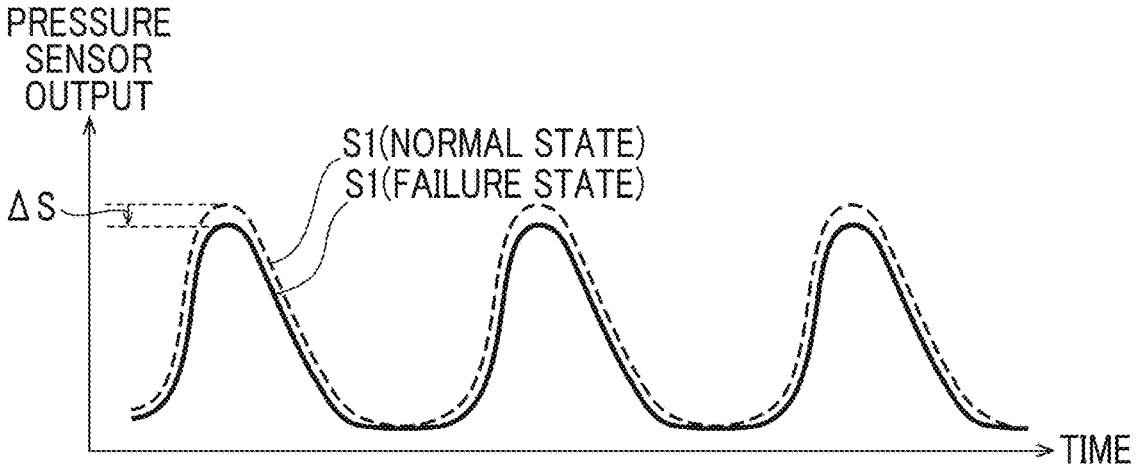
FIG. 11 is a diagram for describing a principle of diagnosing a cryocooler based on a measured pressure waveform according to the embodiment.

FIG. 11 is a diagram for describing a principle of diagnosing the cryocooler 10 based on the measured pressure waveform S1 according to the embodiment. FIG. 11 shows an output of the pressure sensor 50, that is, the measured pressure waveform S1. The measured pressure waveform S1 acquired for the normal cryocooler 10 is shown by a broken line, and the measured pressure waveform S1 acquired for the failed cryocooler 10 is shown by a solid line.

In a case where the cryocooler 10 is operated for a long period of time and a sealing component (for example, the third seal 38*c*) in the expander 14 deteriorates, the working gas leaks from a high pressure region to a low pressure region through the sealing component. Therefore, a peak value of the measured pressure waveform S1 decreases compared to that in the normal state. The amount of decrease ΔS of the peak value increases as a cumulative operation time of the cryocooler 10 becomes longer. The increase in amount of decrease ΔS (that is, an increase in internal leakage) causes a decrease in refrigeration performance of the cryocooler 10. Therefore, the cryocooler 10 can be diagnosed based on the amount of decrease ΔS of the peak value.

Figure 12:
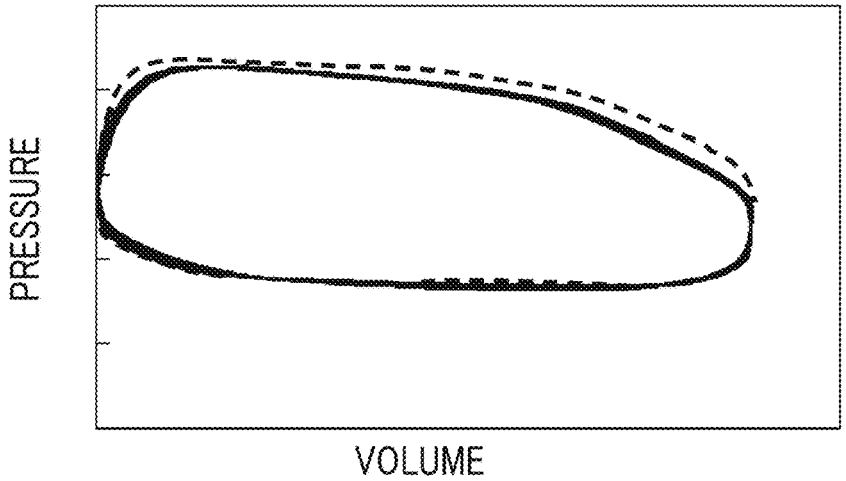
FIG. 12 is an example of a PV diagram of the cryocooler calculated from the measured pressure waveform.

In addition, the calculation processing device 60 may be configured to calculate expansion work (PV work of the expander 14) of the cryocooler 10 based on the measured pressure waveforms S1. FIG. 12 is an example of a PV diagram of the cryocooler 10 calculated from the measured pressure waveform S1. A vertical axis of FIG. 12 shows a pressure (P), and a horizontal axis shows a volume (V).

A PV diagram calculated from the measured pressure waveform S1 of the normal cryocooler 10 is shown by a broken line, and a PV diagram calculated from the measured pressure waveform S1 of the failed cryocooler 10 is shown by a solid line. As is known, the PV work is given by an area of the PV diagram.

The diagnostic device 70 may receive the PV work calculated by the calculation processing device 60 and diagnose the cryocooler 10 based on the PV work. Since the PV work generally well represents the cooling capacity of the cryocooler 10, a threshold may be set for the PV work for diagnosis. The diagnostic device 70 compares the acquired PV work with the threshold, and diagnoses the cryocooler 10 based on a comparison result. The diagnostic device 70 may determine that the cryocooler 1 is normal when the PV work exceeds the threshold, and may determine that the cryocooler 1 is abnormal when the PV work is below the threshold. In this way, the diagnostic device 70 can detect or predict the decrease in cooling capacity of the cryocooler 10.

There is an attempt to predict the failure of the cryocooler by monitoring the cooling temperature of the cryocooler. This is based on the fact that the cryocooler gradually becomes difficult to cool as the cryocooler is used for a long period of time, and the cooling temperature can gradually increase over a long period of time.

However, the cooling temperature depends on not only the cumulative operation time but also the operation conditions of the cryocooler, such as the input heat to a cryogenic temperature section (there is a risk of erroneously detecting an increase in input heat as a decrease in cooling capacity). In addition, the cooling temperature does not necessarily change linearly depending on the cumulative operation time. Therefore, in reality, there are limited cases in which the failure prediction based on the cooling temperature functions well.

In contrast, the diagnosis based on the PV work is not affected by the external heat load on the cryocooler 10. Therefore, it is expected that a more accurate diagnosis can be made as compared to the diagnosis based on the cooling temperature.

Above, the present invention was described based on examples. It will be understood by those skilled in the art that the present invention is not limited to the above-described embodiment, various design changes are possible, various modification examples are possible, and such modification examples are also within the scope of the present invention. Various characteristics described in relation to one embodiment are also applicable to other embodiments. A new embodiment generated through combination also has the effects of each of the combined embodiments.

In the above-described embodiment, the GM cryocooler has been described as an example, but the present invention is not limited to this. In one embodiment, the cryocooler 10 may be another type of cryocooler, such as a Solvay cryocooler, a Stirling cryocooler, or a pulse tube cryocooler.

In the above-described embodiment, a case where the cryocooler 10 is mounted on superconducting equipment such as the MRI system and is used for cooling the superconducting equipment has been described as an example, but this is merely an example. In one embodiment, the cryocooler 10 may be mounted on another cryogenic device such as a cryopump and used for cooling the cryogenic device. The diagnostic technique according to the embodiment can be applied to such a cryogenic device.

Although the present invention has been described using specific words and phrases based on the embodiment, the embodiment merely shows one aspect of the principle and application of the present invention, and various modifications and improvements can be made within the scope of the present invention described in claims.

The present invention can be used in the field of a cryocooler diagnostic system, a cryocooler, and a cryocooler diagnostic method.

It should be understood that the invention is not limited to the above-described embodiment, but may be modified into various forms on the basis of the spirit of the invention. Additionally, the modifications are included in the scope of the invention.

What is claimed is:

1. A cryocooler diagnostic system comprising:

a cryocooler including a pressure sensor that measures a pressure inside the cryocooler;

a calculation processing device comprising a processor and a memory, the calculation processing device being communicably connected to the pressure sensor and configured to:

receive a measured pressure waveform indicating the pressure inside the cryocooler measured by the pressure sensor, and calculate from the measured pressure waveform, at least one of: (i) an amplitude for each of a plurality of frequency components among a drive frequency of the cryocooler and frequency components that are integer multiples of the drive frequency; and (ii) an amplitude of the drive frequency or of a frequency component that is an integer multiple of the drive frequency, and a DC component of the measured pressure waveform; and a diagnostic device comprising a processor and a memory, the diagnostic device being communicably connected to the calculation processing device and configured to:

receive at least one of (i) the amplitudes of the plurality of frequency components and (ii) the amplitude and the DC component, calculated by the calculation processing device, and diagnose the cryocooler based on the at least one of (i) the amplitudes of the plurality of frequency components and (ii) the amplitude and the DC component.

2. The cryocooler diagnostic system according to claim 1, wherein the diagnostic device is configured to diagnose a plurality of failure modes of the cryocooler.

3. The cryocooler diagnostic system according to claim 1, wherein the calculation processing device is configured to calculate expansion work of the cryocooler based on the measured pressure waveform.

4. The cryocooler diagnostic system according to claim 1, wherein the diagnostic device is disposed remotely from the calculation processing device, and is configured to receive at least one of (i) the amplitudes of the plurality of frequency components and (ii) the amplitude and the DC component, calculated by the calculation processing device via a communication network.

5. The cryocooler diagnostic system according to claim 1, wherein the cryocooler includes an expander and a pressure switching valve that operates to generate a periodic pressure fluctuation in the expander, and the pressure sensor is disposed to measure the periodic pressure fluctuation generated in the expander.

6. A cryocooler diagnostic system comprising:

a diagnostic device comprising a processor and a memory, the diagnostic device being configured to:

acquire from a measured pressure waveform indicating a pressure inside a cryocooler, at least one of: (i) an amplitude for each of a plurality of frequency components among a drive frequency of the cryocooler and frequency components that are integer multiples of the drive frequency; and (ii) an amplitude of the drive frequency or of a frequency component that is an integer multiple of the drive frequency, and a DC component of the measured pressure waveform, and diagnose the cryocooler based on the at least one of (i) the amplitudes of the plurality of frequency ponents and (ii) the amplitude and the DC component.

7. A cryocooler comprising:

a pressure sensor that measures a pressure inside the cryocooler; and a calculation processing device comprising a processor and a memory, the calculation processing device being communicably connected to the pressure sensor and configured to:

receive a measured pressure waveform indicating the pressure inside the cryocooler measured by the pressure sensor, and calculate from the measured pressure waveform, at least one of: (i) an amplitude for each of a plurality of frequency components among a drive frequency of the cryocooler and frequency components that are integer multiples of the drive frequency; and (ii) an amplitude of the drive frequency or of a frequency component that is an integer multiple of the drive frequency, and a DC component of the measured pressure waveform.

8. A cryocooler diagnostic method comprising:

acquiring a measured pressure waveform indicating a pressure inside a cryocooler;

calculating from the measured pressure waveform, at least one of: (i) an amplitude for each of a plurality of frequency components among a drive frequency of the cryocooler and frequency components that are integer multiples of the drive frequency; and (ii) an amplitude of the drive frequency or of a frequency component that is an integer multiple of the drive frequency, and a DC component of the measured pressure waveform; and diagnosing the cryocooler based on the at least one of (i) the amplitudes of the plurality of frequency components and (ii) the amplitude and the DC component.

* * * * *